2/11/86 X5 4,569,800

United States Patent [19]

Stanley et al.

[11] Patent Number: 4,569,800

[45] Date of Patent: Feb. 11, 1986

[54] QUATERNARY AMMONIUM SALTS USEFUL AS FABRIC SOFTENERS

[75] Inventors: Keith D. Stanley, Downers Grove; Kenneth B. White, Chicago, both of Ill.

[73] Assignee: Akzona Incorporated, Enka, N.C.

[21] Appl. No.: 516,140

[22] Filed: Jul. 21, 1983

[51] Int. Cl.[4] ..... C07C 87/30; D06M 13/46

[52] U.S. Cl. ..... 260/501.15; 252/8.8; 564/291

[58] Field of Search ..... 260/501.15; 564/291; 252/8.8

[56] References Cited

U.S. PATENT DOCUMENTS

| | | | |
|---|---|---|---|
| 3,274,106 | 9/1966 | Smiens | 252/8.75 |
| 3,573,091 | 3/1971 | Waldman et al. | 252/8.8 |
| 3,803,137 | 4/1974 | Egan et al. | 252/8.8 |
| 3,819,656 | 8/1974 | Barle, Jr. et al. | 260/501.15 |
| 3,834,867 | 9/1974 | Matter et al. | 564/291 |
| 4,134,838 | 1/1979 | Hooper et al. | 252/8.8 |
| 4,152,288 | 5/1979 | Friedman, Jr. et al. | 252/305 |
| 4,214,998 | 7/1980 | Joy | 252/8.8 |
| 4,259,393 | 3/1981 | Demessemaekers et al. | 427/242 |
| 4,341,644 | 7/1982 | Bisschops et al. | 252/8.8 |

*Primary Examiner*—Glennon H. Hollrah
*Assistant Examiner*—Raymond Covington
*Attorney, Agent, or Firm*—Francis W. Young; Louis A. Morris; Jeffrey S. Boone

[57] ABSTRACT

A novel composition of matter, the quaternary ammonium salt having the formula:

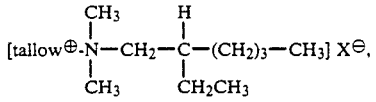

wherein $X^{\ominus}$ is $Cl^{\ominus}$, $I^{\ominus}$, $Br^{\ominus}$, or $OSO_3CH_3^{\ominus}$, which forms a fabric softening compound that is soluble in water and/or isopropyl alcohol to form a true solution, wherein the compound is clear and colorless at 70° F. The compound remains as a solution in water even at composition/water weight ratios of 75:25.

11 Claims, No Drawings

QUATERNARY AMMONIUM SALTS USEFUL AS FABRIC SOFTENERS

BACKGROUND OF THE INVENTION

The present invention pertains to a novel composition of matter, particularly to quaternary ammonium salts, and most specifically to a hydrogenated tallowalkyl 2-ethylhexyl dimethylammonium chloride, and to a fabric softening compound including this novel composition.

Quaternary ammonium salts are well known as fabric softening agents, and may be combined with solvents such as water or isopropyl alcohol to form dispersions that are suitable as fabric softening compounds. For example, U.S. Pat. No. 4,214,998, issued to Joy on July 29, 1980, and entitled "Quaternary Ammonium Compounds Useful as Fabric Softening Agents," discloses a quaternary ammonium salt that includes an alkyl group having a somewhat longer chain length at the position corresponding to the 2-ethylhexyl branch of the present composition. Further, U.S. Pat. No. 3,803,137, issued to Egan et al on April 8, 1974, and entitled "Mixtures of Aliphatic Amines and Quaternary Ammonium Compounds Thereof," discloses a blend of amines and quats having utility as fabric softeners. The 2-ethylhexyl branch of the present invention is not among the R groups disclosed in the Egan quaternaries. Finally, U.S. Pat. No. 4,341,644, issued to Bisschops et al on July 27, 1982, and entitled "Quaternary Ammonium Salt Mixtures," discloses quaternaries having alkyl groups that are longer than the present 2-ethylhexyl group. Further, the Bisschops quats are only slightly dispersible in water, undergoing gelification at quat concentrations in excess of about 15%. See Bisschops, column 6, lines 64–68, and column 7, lines 1–4.

SUMMARY OF THE INVENTION

The present invention is a composition of matter having the formula:

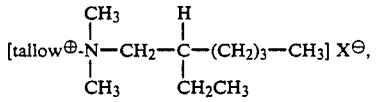

wherein $X^{\ominus}$ is $Cl^{\ominus}$, $I^{\ominus}$, $Br^{\ominus}$, or $OSO_3CH_3^{\ominus}$, otherwise known as hydrogenated tallowalkyl 2-ethylhexyl dimethylammonium salts. The chloride salt finds utility in another aspect of the invention, a fabric softening compound that includes this composition and a solvent. The compound forms a true solution and displays several surprising characteristics, including the aesthetically pleasing aspects of clarity and colorlessness at a temperature of 70° F. The most preferred solvents for the fabric softening compound are ethanol, water, isopropyl alcohol (isopropanol), or a blend of water and isopropanol.

Utilizing these solvents, the present fabric softening compounds may be used with good effect at solids concentrations of either 3% (wt.) or 6% (wt.). The rewet characteristics of fabrics treated with the compound at these concentrations are outstanding and approach those of fabrics washed and rinsed in plain water.

Further, the present compounds may be used at weight ratios of the quat:solvent of 75:25 in isopropyl alcohol or water. Such 75:25 blends remain clear and colorless at 70° F., are a true solution rather than a dispersion, and demonstrate no gelification. As a result of this high concentration of active quaternary ingredient in the softening compound, the solids content of the compound is high and a much smaller amount of the compound in a rinse cycle will provide the same softening effect as a relatively large amount of a compound at a 3–6% quaternary concentration.

In summary, fabric softeners made from the present novel composition demonstrate a unique combination of desirable softening compound characteristics, including high solids content solubility and clarity and colorlessness at room temperature. The softeners impart to fabrics treated therewith excellent rewet and hand.

Thus, objects of the invention include the manufacture of a novel quaternary ammonium chloride and a superior fabric softening compound comprising the novel quat.

DESCRIPTION OF THE PREFERRED EMBODIMENT

The present novel composition may be manufactured in either of three preferred ways. The first preferred way is to treat a tallowamine with 2-ethylhexanal at an elevated temperature and atmospheric pressure to form 2-ethyl hexilidine tallow imine. Water is formed in this reaction, and the amount thereof is lowered to about 2% of the sum of the weights of the water and imine by heating at about 105° C. in the presence of nitrogen, which is gently blown through the reactor. The dried imine is heated to a temperature ranging from about slightly above room temperature to about 180° C. at 300–1000 psig hydrogen and in the presence of 0.2%–2.0% of a catalyst, the amount of catalyst being based upon the total weight of imine. After the heating is completed, the product comprises the secondary amine, hydrogenated tallow 2-ethylhexyl amine. The present composition results when this secondary amine is methylated with two moles of methyl chloride per mole of amine in the presence of a solvent. Sodium bicarbonate or another base are used in the reaction so as to neutralize the hydrochloric acid formed in reaction.

The second preferred embodiment for the manufacture of the present composition comprises reacting the tallowamine with 2-ethyl hexanal at a 1:1 molar ratio or with a slight excess of the aldehyde and in the presence of 0.2%–2.0% of a catalyst, the amount of catalyst being based upon the total weight of primary amine. The blend is reacted at a temperature between slightly above room temperature and 180° C., and at a hydrogen pressure of between 100 and 1000 psig. The secondary amine, hydrogenated tallow 2-ethylhexylamine, in this second preferred method is produced notwithstanding the presence of water in the reaction mixture. The secondary amine is quaternized with methyl chloride, a solvent, and a base in the manner described hereinabove.

In a third and most preferred method, the secondary amine is made in accordance with the procedures set forth in the first or second preferred methods described hereinabove. This amine is reacted with methyl formcel (formaldehyde in methanol) in the presence of a catalyst and hydrogen to yield the tertiary amine, methyl hydrogenated tallow 2-ethylhexylamine. The catalyst used in the conversion to the tertiary amine need not be added with the methyl formcel and hydrogen, as catalyst used in the conversion to the secondary amine is not separated therefrom after completion of that conversion. This catalyst in the secondary amine retains its catalytic effect in the reaction to the tertiary amine. The tertiary amine can be quaternized with 1 mole of methyl chloride per mole of amine in the presence or absence of a solvent. The tertiary amine may also be quaternized with dimethyl sulfate or other known quaternizing reagents.

The following examples will demonstrate the manufacture of the present novel composition in accordance with the above described preferred embodiments.

EXAMPLE 1

The first of the aforementioned preferred embodiments comprises adding 253.0 grams (0.945 gram moles) of Armeen ®T, a tallowamine manufactured by the Armak Company, 300 South Wacker Drive, Chicago, IL. 60606, and 2% (molar) acetic acid to a one-liter, 3-necked round bottom flask equipped with mechanical stirring means, a Dean-Stark trap, an addition funnel, and a controlled heating mantle. The flask is heated until the contents are at 110° C., and 123.6 grams (0.945 gram moles) of 2-ethylhexanal are added thereto over the next one hour. In the interim, 10 ml of water were collected, and an additional 5.3 ml are collected over the next 1 hour and 50 minutes. Gas chromatographic analysis of the mixture discloses about 92% tallowalkyl 2-ethylhexylimine.

Three hundred and fifty-three grams of this imine, used now as a reactant, and 3.5 g. of 5132P Harshaw nickel catalyst are placed in a one-liter Parr autoclave having a nitrogen purge line connected thereto. The reactor is purged with 50 psig (hydrogen) and then vented six times in succession. The contents are heated to and maintained at 150° C. in the reactor, which has been pressurized with 600 psig hydrogen. After 1 hour and 20 minutes at this temperature and pressure, gas chromatographic analysis indicates about 73% tallow 2-ethylhexylamine, about 20% di(2-ethylhexyl)amine, and 7% of the imine reactant.

Two hundred and seventy-one and one-half grams (0.698 gram moles) of this amine, 79.1 grams of the solvent isopropyl alcohol, 76.2 grams of sodium bicarbonate ($NaHC0_3$), 2.0 grams of sodium bisulfite ($NaHs0_3$), and 54 mg of the color stabilizing agent Dissolvine ®NA2, which is a trademark for a brand of an EDTA-disodium salt, and which is manufactured by Akzo Chemie, Stationsstraat 48, Amersfoort, The Netherlands, are added to a one-liter Parr autoclave made of Carpenter 20/E alloy. The autoclave or reactor is communicative through a nitrogen purge line with a one-liter 316 stainless steel bomb, and the reactor is purged twice with nitrogen. The autoclave's contents are heated to 100° C., and then methyl chloride is added to the reactor until a pressure of 175 psig is attained. As the methylation proceeds over the next ninety minutes, the reactor pressure builds and it must be relieved occasionally by venting to 200 psig. At ninety minutes after the introduction of the methyl chloride, the reactor is vented to 100 psig, closed again, and the additional methyl chloride added until a pressure of 180 psig is attained. After an additional five and one-half hours, the reaction has gone essentially to completion. An analysis of the reactor contents indicates that 8.3% free amine and 2.1% amine hydrochloride salt remain in the mix. The rest of the product is primarily the present novel composition, hydrogenated tallowalkyl 2-ethylhexyl dimethylammonium chloride.

EXAMPLE 2

In this second of the preferred embodiments, 341.9 grams of Armeen ®TMD aliphatic amine, Armak's distilled-grade tallowamine, and 1.7 grams (0.5% (wt.) of the amine) of a palladium on carbon catalyst are added to a one-liter Parr autoclave. The reactor is then purged by pressurization with nitrogen and vented three times in succession. The pressure of the autoclave is checked and thereafter the autoclave is pressurized with nitrogen and vented twice more. Finally, the contents are heated to 135° C. and with the reactor pressurized to 300 psig with H2, 2-ethylhexanal is added gradually and at a substantially uniform rate over the next three hours. The reaction mixture is permitted to digest over the next half hour, at which time gas chromatographic analysis disclosed 94.12% conversion to the secondary amine, hydrogenated tallowalkyl 2-ethylhexylamine, with approximately 2.54% remaining as unreacted primary amine and 1.25% conversion to the tertiary amine. The mixture was allowed to digest for several more hours at 135° C., and the reactor pressure increased to 400 psig with hydrogen as necessary. Upon discharge of the mixture from the reactor the following day, the water therein was visually distinct and separated, and the remaining product was filtered. The filtrate was substantially all hydrogenated tallowalkyl 2-ethylhexylamine, which was methylated to form the present novel quaternary ammonium chloride in accordance with the methylation procedure set forth hereinabove at Example 1.

EXAMPLE 3

The third and most preferred embodiment comprises manufacturing the hydrogenated tallow 2-ethylhexylamine in accordance with the procedures set forth in Example 2 above, and then methylating that amine with methyl formcel.

For example, 695 grams (2.653 gram moles) of Armeen ®TMD aliphatic amine, Armak's trademark for primary distilled tallowamine, and 3.4 grams of a palladium on carbon catalyst are charged to a one-liter Parr stainless steel autoclave communicative with a 500 ml buret having a Milroyal pump. After purging and venting the reactor several times with 50 psig nitrogen, its contents are heated to 134° C. and pressurized with hydrogen to 300 psig. Over the next 3 hours and 27 minutes, 439 ml (360 grams, 2.81 gram moles) of 2-ethylhexanal are pumped into the reactor. Gas chromatographic analysis of the reactor contents 30 minutes later indicates that 87.8% of the mixture is the secondary amine, hydrogenated tallowalkyl 2-ethylhexylamine. Over the next 1 hour and 12 minutes, with the mixture still at 135° C. and 300 psig hydrogen pressure, 155 ml (164 grams, 3.01 gram moles) of methyl formcel (a mix of 55% formaldehyde and 45% methanol) are pumped into the reactor. Analysis discloses no primary or secondary amine and 93.6% of the tertiary amine, hydrogenated tallowalkyl methyl 2-ethylhexylamine.

This tertiary amine may be quaternized with methyl chloride in the presence or absence of a solvent. For example, 271 grams of the tertiary amine and 54.2 grams (20% of the weight of the amine) of sodium bicarbonate may be charged to a nitrogen-purged reactor and heated to 100° C., then treated with an excess of 200 psig methyl chloride for about 9 hours and 30 minutes. Analysis of the reaction mixture indicated about 1.4% of the amine salt, 0.9% of the free amine, and 93.7% of the present quaternary ammonium chloride.

In contrast, the tertiary amine may be methylated in the presence of a solvent by adding 326 grams (0.784 gram moles) of the amine, 91.4 grams of the solvent isopropanol, and 32 grams of sodium bicarbonate to a nitrogen-purged reactor, heating the contents to 100° C., and adding 200 psig methyl chloride for the next 3 hours and 15 minutes. Sampling and analysis at the end of the methylation indicated 4.7% free amine and 0.3% ammonium hydrochloride salt. The balance is essentially entirely comprised of the present quaternary ammonium chloride.

EXAMPLE 4

This example will demonstrate significant and in many cases unexpectedly good properties of the present novel composition and of the present compounds including this composition. The compounds were first prepared in 3% (solids) and 6% (solids) concentrations by blending the hydrogenated tallowalkyl dimethyl 2-ethylhexylammonium chloride with hot water. For example, a 3.0% solids formulation may be prepared by blending 24.29 grams of the present composition as disclosed in Example 1, which has a solids content of 74.1%, with 575.71 grams of hot water. This compound and several others like it were prepared, the only differences being the inclusion in the various compounds of the present compositions manufactured in various batches. Each composition had a solids content of from 70.2 to 75.0% and a free amine content of from 2.3 to 8.5%.

The efficacy of the softener compounds was evaluated by an experienced panel of persons touch-testing both treated fabrics and untreated control fabrics and comparing their respective softness. Nylon, polyester, and 65% polyester/35% cotton (65/35 P/C) fabrics were evaluated after both 1 and 5 wash-dry cycles, the treated fabrics having been treated with a softener during each wash cycle. The control fabrics were washed and dried one and five times without using a softening agent. Further, other samples of these same fabrics were washed and dried in the same manner in 3.0% and 6.0% (solids) solutions of the prior art softeners Varisoft-222 and also in Arquad ®2T-75 and Arquad ®2HT-75 quaternary ammonium chlorides. Varisoft is the brand name for a softener manufactured by the Sherex Chemical Corporation, Dublin, Ohio, and the Arquad ® quaternary ammonium chlorides are manufactured by the Armak Company, Industrial Chemicals Division, 300 S. Wacker Drive, Chicago, IL. 60606. Each of sixty panelists touch-tested each of the two treated and one untreated control fabrics after one wash-dry cycle and five wash-dry cycles, and awarded one point to that fabric that was softest to his touch and zero points to the other two fabrics. The compounds of the present invention were found to significantly soften the fabrics tested when compared to untreated fabrics and were found to be as effective as the prior art softeners.

In addition, the rewet of fabrics treated with the present compounds and the prior art compounds cited hereinabove was evaluated. Rewet is a measure of a fabric's adsorbency, and is determined by measuring the height to which water rises in a strip of fabric having one end immersed in dyed water. About one inch of a 2"×18" cotton strip is suspended into a 3" depth of a 0.1% solution of Drimarene Bordeaux Z-BL dye contained in a one liter graduated glass cylinder. The height to which the dyed water has been absorbed may be visually ascertained, and is measured at 5, 10, 20, and 30 minutes. The results are determined by averaging duplicate samples.

The present compounds will also increase the antistatic properties of the fabric. The antistatic characteristics were measured by comparing the static ("cling" tendency) properties of treated fabrics with untreated fabrics. The treated fabrics were given a rating relative to one chosen arbitrarily for the control. For nylon control fabrics, a rating of 10 is given; for 100% polyester control fabrics, a rating of 8 is given; and for a 65/35 polyester/cotton fabric a rating of 5 is given. A rating for the softener-treated fabric that is numerically less than that for the control indicates that the softener imparts antistatic characteristics to the fabric; the larger the difference in the ratings, the better the antistat effect imparted by that particular softener.

The results of the softening, rewet, and antistat tests are recorded in Tables 1–4:

TABLE 1

Comparison of softening, rewet, and antistat characteristics of 3% solution of hydrogenated tallow 2-ethylhexyl quaternary ammonium chloride (HTL8-1470-134) vs. 3% dispersion of Varisoft-222.

| | Softening, after indicated number of wash-dry cycles | | Rewet, cm. | Antistat | | |
|---|---|---|---|---|---|---|
| | 1 | 5 | after 30 min. | 100% nylon | 65/35 P/C | 100% polyester |
| HTL8-1470-134 (Ni catalyst) | 28 | 37 | 5 | 5 | 4 | 4 |
| Varisoft-222 | 20 | 23 | 6.3 | 5 | 3 | 4 |
| Control | 12 | 0 | 17.8 | 10 | 5 | 8 |

TABLE 2

Comparison of softening, rewet, and antistat characteristics of 3% solution of hydrogenated tallow 2-ethylhexyl quaternary ammonium chloride (HTL8-1491-57) vs. 3% dispersion of Varisoft-222.

| | Softening, after indicated number of wash-dry cycles | | Rewet, cm. | Antistat | | |
|---|---|---|---|---|---|---|
| | 1 | 5 | after 30 min. | 100% nylon | 65/35 P/C | 100% polyester |
| HTL8-1491-57 (palladium catalyst) | 26 | 38 | 22 | 1 | 2 | 2 |
| Varisoft-222 | 18 | 18 | 14 | 8 | 3 | 4 |
| Control | 18 | 4 | 22 | 10 | 5 | 8 |

TABLE 3

Comparison of softening, rewet, and antistat characteristics of 6% solution of hydrogenated tallow 2-ethylhexyl quaternary ammonium chloride (HTL8-1456-107) vs. 6% dispersion of Arquad ® 2T quaternary ammonium chloride (lot no. 6030000-9).

| | Softening, after indicated number of wash-dry cycles | | Rewet, cm. | Antistat | | |
|---|---|---|---|---|---|---|
| | 1 | 5 | after 30 min. | 100% nylon | 65/35 P/C | 100% polyester |
| HTL8-1456-107 | 23 | 31 | 22.0 | 2 | 1 | 2 |
| Arquad ® 2T | 30 | 25 | 8.5 | 1 | 1 | 2 |
| Control | 7 | 4 | 22.5 | 10 | 5 | 8 |

TABLE 4

Comparison of softening, rewet, and antistat characteristics of 6% solution of hydrogenated tallow 2-ethylhexyl quaternary ammonium chloride (HTL8-1456-135) vs. 6% dispersion of Arquad ® 2HT quaternary ammonium chloride (lot no. 7215903).

| | Softening, after indicated number of wash-dry cycles | | Rewet, cm. | Antistat | | |
|---|---|---|---|---|---|---|
| | 1 | 5 | after 30 min. | 100% nylon | 65/35 P/C | 100% polyester |
| HTL8-1456-135 | 26 | 27 | 21.0 | 3 | 1 | 3 |
| Arquad ® 2HT | 32 | 29 | 4.5 | 2 | 1 | 3 |
| Control | 2 | 4 | 23.0 | 10 | 5 | 8 |

Softening, antistat, and rewet comparisons between 6% (solids) water solutions of the present composition and 6% (solids) water solutions or dispersions of structurally similar compositions were made in accordance with the testing procedure described hereinabove. The structurally similar compositions included tallow n-butyl dimethyl quaternary ammonium chloride, hereinafter referred to as 4T; tallow isobutyl dimethyl quaternary ammonium chloride (L4T); tallow hexyl dimethyl octyl dimethyl quaternary ammonium chloride (6T); tallow octyldimethyl quaternary ammonium chloride (HT8); hydrogenated tallow 1-methylheptyl dimethyl quaternary ammonium chloride (MHTK8); and docosanyl ($C_{22}$ alkyl radical) 2-ethylhexyl quaternary ammonium chloride (L8HF). The results of the comparisons are set forth in Table 5:

TABLE 5

Softening and antistat comparisons of present composition and structurally similar compositions. (All compositions demonstrated excellent rewet).

| | Softening | | Antistat | | |
|---|---|---|---|---|---|
| | 1 cycle | 5 cycles | 100% Nylon | 65/35 P/C | 100% Polyester |
| HTL8 | 30 | 39 | 2 | 1 | 2 |
| 4T | 20 | 14 | 3 | 1 | 2 |
| Control | 10 | 7 | 10 | 5 | 8 |
| HTL8 | 30 | 36 | 2 | 1 | 2 |
| L4T | 19 | 23 | 2 | 3 | 3 |
| Control | 11 | 1 | 10 | 5 | 8 |
| HTL8 | 29 | 37 | 2 | 1 | 2 |
| 6T | 24 | 21 | 7 | 1 | 3 |
| Control | 7 | 2 | 10 | 5 | 8 |
| HTL8 | 27 | 31 | 2 | 1 | 2 |
| HT8 | 27 | 23 | 3 | 1 | 2 |
| Control | 6 | 6 | 10 | 5 | 8 |
| HTL8 | 31 | 35 | 2 | 1 | 2 |
| MHTK8 | 21 | 23 | 5 | 2 | 2 |
| Control | 8 | 2 | 10 | 5 | 8 |
| HTL8 | 39 | 39 | 2 | 1 | 2 |
| L8HF | 10 | 10 | 3 | 3 | 6 |
| Control | 11 | 11 | 10 | 5 | 8 |

Further, the present composition and the above structurally similar compositions were tested for water solubility. The isopropanol solvent in each was stripped off to leave a residue, and to this residue was added sufficient water so as to comprise 10–20% of the total weight of the water-residue blend.

When water was added to 4T, L4T, 6T, and HFL8 at room temperature, the blend did not form a solution and instead formed either a solid or gel. These compositions were dispersible in the above-noted proportions at elevated temperatures, but became gels or solids upon cooling to room temperature.

When water was added to HT8 and MHTK8 at room temperature, thick, non-flowing gels formed. The gels became homogeneous fluids upon heating.

In contrast, hydrogenated tallow 2-ethylhexyl quaternary ammonium chloride was soluble in all proportions of water:quat, at both room temperature and elevated temperatures. In all proportions and at all temperatures tested, the solutions were clear and colorless.

Cloud point and pour points were determined for the present composition and the above-mentioned structurally similar compositions. These results are set forth in Table 6 and indicate that the present composition is equal to or superior to all others tested. The cloud point is a particularly important criterion in that clarity of the softener at a given temperature is directly related thereto.

TABLE 6

Pour points (°F.) and cloud points (°F.) of present composition and structurally similar compositions, 75% solids in isopropanol.

| Composition | Branched (B) or Unbranched (U) | Pour pt., °F. | Cloud pt., °F. |
|---|---|---|---|
| 4T | U | 61 | 69 |
| 4LT | B | 45 | 50 |
| 6T | U | 63 | 65 |
| HT8 | U | 33 | 42 |
| HFL8 | B | 60 | 64 |
| HTL8 | B | 23 | 27 |
| MHTK8 | B | 22 | 26 |

It was noted that MHTK8 did not prove to be as effecive a softener as the present compounds.

Further advantages of the present composition, in addition to its excellent solubility in water, isopropanol, or a water/isopropanol blend, include its clarity and colorlessness in solution. Prior art softeners at concentrations as low as 3% are opaque, colored suspensions rather than solutions, typically having a light blue or pink hue. In order to keep these prior art softeners in suspension, only about 3–15% of the active ingredient (solids content) is placed in 85–97% solvent; levels about 15% conventional quats in water solvents undergo gelification. See Bisschops, cited hereinabove, col. 6, lines 64–68, and col. 7, lines 1–4. Thus, the solvent is a large part of the softening compound and a relatively large quantity of this compound must be added to the rinse water to provide a given level of solids therein, the solids being a relatively minor part of the softening compound.

In contrast, the present composition forms softening compounds that are true solutions and that are clear and colorless at room temperature at any ratio of composition to solvent, and which still exhibit rewet and softening properties comparable to and frequently superior to those of prior art compounds. The present compound is a clear liquid at room temperature even when the solvent is not pure isopropanol, and has a much lower cloud and pour point than structurally similar compounds.

What is claimed is:

1. A compound having the formula:

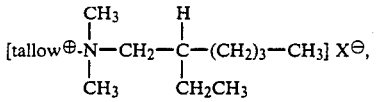

wherein X⊖ is Cl⊖, I⊖, Br⊖, or $OSO_3CH_3$⊖.

2. A fabric softening composition, comprising at least 3% (wt.) of the compound:

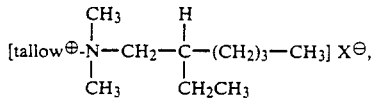

wherein X⊖ is Cl⊖, I⊖, Br⊖, or $OSO_3CH_3$⊖ and wherein said compound is soluble in a solvent to form said composition which is a true solution of said compound and said solvent, said composition being clear and colorless at 70? F.

3. The composition as set forth in claim 2, wherein said solvent is selected from the group including ethanol water, isopropyl alcohol, or a blend of water and isopropyl alcohol.

4. The composition as set forth in claim 2, wherein said composition has a solids content of at least 3.0% (wt.).

5. The composition as set forth in claim 3, wherein said composition has a solids content of at least 3.0% (wt.).

6. The composition as set forth in claim 2, wherein said composition has a solids content of at least 6.0% (wt.).

7. The composition as set forth in claim 3, wherein said composition has a solids content of at least 6.0% (wt.).

8. The composition as set forth in claim 2, wherein the weight ratio of said compound to said solvent is at least 75:25.

9. The composition as set forth in claim 8, wherein said solvent is isopropyl alcohol.

10. The compound of claim 1 wherein said tallow group is hydrogenated.

11. The composition of claim 2 wherein said tallow group is hydrogenated.

* * * * *